US008752517B2

(12) United States Patent
Boese et al.

(10) Patent No.: US 8,752,517 B2
(45) Date of Patent: Jun. 17, 2014

(54) IMPELLER OF A DEVICE FOR VARIABLE ADJUSTMENT OF THE CONTROL TIMES OF GAS EXCHANGE VALVES OF AN INTERNAL COMBUSTION ENGINE

(75) Inventors: Olaf Boese, Nuremberg (DE); Mario Arnold, Aurachtal (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 24 days.

(21) Appl. No.: 13/576,048

(22) PCT Filed: Jan. 20, 2011

(86) PCT No.: PCT/EP2011/050751

§ 371 (c)(1),
(2), (4) Date: Jul. 30, 2012

(87) PCT Pub. No.: WO2011/098331

PCT Pub. Date: Aug. 18, 2011

(65) Prior Publication Data

US 2012/0298060 A1 Nov. 29, 2012

(30) Foreign Application Priority Data

Feb. 15, 2010 (DE) ..... 10 2010 008 006

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,836,277 | A | 11/1998 | Kira et al. | |
| 2006/0278189 | A1 * | 12/2006 | Knecht et al. | 123/90.17 |

FOREIGN PATENT DOCUMENTS

| | | |
|---|---|---|
| DE | 1013420 | 8/1957 |
| DE | 102005026553 | 9/2006 |
| DE | 102006019607 | 10/2007 |
| DE | 102007041552 | 3/2009 |
| DE | 102008023151 | 3/2009 |
| EP | 1865158 | 12/2007 |
| WO | 03076771 | 9/2003 |

* cited by examiner

*Primary Examiner* — Zelalem Eshete
(74) *Attorney, Agent, or Firm* — Volpe and Koenig, P.C.

(57) ABSTRACT

An impeller (15) of a device (11) for variable adjustment of the control times of gas exchange valves (9, 10) of an internal combustion engine (1) having a substantially cylindrical hub element (17) and at least one blade (18) which extends radially to the outside proceeding from the hub element (17), wherein at least the hub element (17) is produced from a non-metallic material.

8 Claims, 2 Drawing Sheets

IMPELLER OF A DEVICE FOR VARIABLE ADJUSTMENT OF THE CONTROL TIMES OF GAS EXCHANGE VALVES OF AN INTERNAL COMBUSTION ENGINE

FIELD OF THE INVENTION

The invention relates to an impeller of a device for variable adjustment of the control times of gas exchange valves of an internal combustion engine with an essentially cylindrical hub element and at least one vane that extends outward in the radial direction starting from the hub element, wherein at least the hub element is produced from a non-metallic material.

BACKGROUND

In modern internal combustion engines, devices for the variable adjustment of the control times of gas exchange valves are used to be able to vary the phase relation between the crankshaft and camshaft in a defined angle range between a maximum advanced position and a maximum retarded position. The device is integrated in a drive train by means of which torque is transmitted from the crankshaft to the camshaft. This drive train can be realized, for example, as a belt, chain, or gearwheel drive. In addition, the device is locked in rotation with a camshaft and has one or more pressure chambers by means of which the phase relation between the crankshaft and the camshaft can be varied selectively.

Such a device is known, for example, from DE 10 2007 041 552 A1. The device has a cell wheel, an impeller, and two side covers, wherein the cell wheel is in driven connection with a crankshaft and the impeller is locked in rotation on a camshaft. Here, the impeller is arranged so that it can pivot relative to the cell wheel in a defined angle interval. The side covers are arranged on the axial side surfaces of the impeller and the cell wheel and locked in rotation with the cell wheel by means of screws. The impeller includes an essentially cylindrical hub element and several separate vanes. The vanes are arranged in vane grooves that are constructed on the cylindrical outer lateral surface of the hub element and extend outward in the radial direction. In the hub element there are several hollow spaces that extend in the axial direction and are open on both axial side surfaces of the hub element.

The cell wheel, the impeller, and the side covers bound several pressure spaces. Each of the pressure spaces is divided by one of the vanes into pressure chambers that act against each other and form a hydraulic adjustment drive by means of which the phase position between the impeller and the cell wheel can be varied. The pressurized medium supply to and the pressurized medium discharge from the pressure chambers is realized via pressurized medium channels formed in the hub element. The pressurized medium channels communicate on one side with a central opening of the impeller and on the other side with the pressure chambers. The pressurized medium channels are constructed as boreholes that are formed in the hub element after the shaping process of the hub element.

Another device is known from U.S. Pat. No. 5,836,277 A. In this embodiment, pressurized medium channels are constructed as radial grooves on the axial side surfaces of the impeller.

Another device is known from DE 101 34 320 A1. In this embodiment, the vanes are formed integrally with the hub element. The integrally formed impeller is made from a plastic.

The present invention is based on the objective of specifying a cost-optimized and weight-optimized impeller of a device for the variable adjustment of the control times of gas exchange valves of an internal combustion engine.

SUMMARY

This objective is met according to the invention in that the impeller is made from at least two sub-elements that are set opposite each other in the direction of an axis of rotation of the impeller and contact each other, wherein the sub-elements are connected to each other and wherein at least one recess is formed at least on one of the contacting side surfaces of the sub-elements.

The impeller has an essentially cylindrical hub element and at least one vane that extends outward in the radial direction starting from an outer cylindrical lateral surface of the hub element. The vane can be constructed, for example, integrally with the hub element. Alternatively, the vane can be produced separately from the hub element and connected to this element, for example, it can be inserted into a groove formed on the hub element. At least the hub element is made from a non-metallic material, for example, a plastic, wherein the weight of the impeller is reduced in comparison with metallic impellers. In addition, the vane could also be made from a non-metallic material. The impeller includes at least two sub-elements that are set opposite each other in the direction of an axis of rotation of the impeller and contact each other. Here, the separating plane of the sub-elements can be penetrated by the axis of rotation of the impeller, for example, vertically, so that an axial side surface of one sub-element contacts an axial side surface of another sub-element. The sub-elements are connected to each other, for example, by means of an adhesive connection or a weld connection (e.g., by means of ultrasonic welding) or by means of a non-positive-fit or positive-fit connection. In addition it is provided that at least one recess is formed at least on one of the side surfaces of the sub-elements that contact each other. The recesses could have already been produced during the shaping process. For example, these could be taken into account in the mold of an injection-molding tool. Through this construction of the impeller, the recess of a sub-element is closed in the axial direction by another sub-element. The recess can be formed, for example, with a blind hole shape. In this case, an outwardly closed hollow space is realized in the impeller, so that the weight and the material requirements for producing the impeller are reduced. After assembling the device, the axial side surfaces of the impeller form a sealing contact on the side covers of the device, in order to minimize leakage from the pressure chambers inward in the radial direction. Because there are no openings on the axial side surfaces of the impeller in the area of the hollow spaces, the sealing length is made longer in this area, wherein leakage is reduced.

Alternatively or additionally, the recess could be constructed as a groove that extends outward in the radial direction starting from a central opening of the impeller and opens into an area, for example, a pressure chamber, adjacent to the vanes in the peripheral direction. In this case, the grooves are covered, in turn, by another sub-element in the axial direction. The grooves could thus be used as pressurized medium channels for feeding pressurized medium to or for discharging pressurized medium from the pressure chambers. Through this construction of the pressurized medium channels, these are arranged within the impeller, without cost-intensive post processing steps, for example, drilling the pressurized medium channels, being necessary. Because pressurized medium is led in this embodiment within the impeller to the pressure chambers and does not come in contact with one of the side covers, no transverse forces act on the impeller, wherein these forces would press the impeller against one of the side covers and thus would increase the wear at this point.

BRIEF DESCRIPTION OF THE DRAWINGS

Additional features of the invention can be found in the following description and from the drawings in which an embodiment of the invention is shown in simplified form. Shown are.

DETAILED DESCRIPTION OF THE PREFERRED EMBODIMENTS

Figure 1:
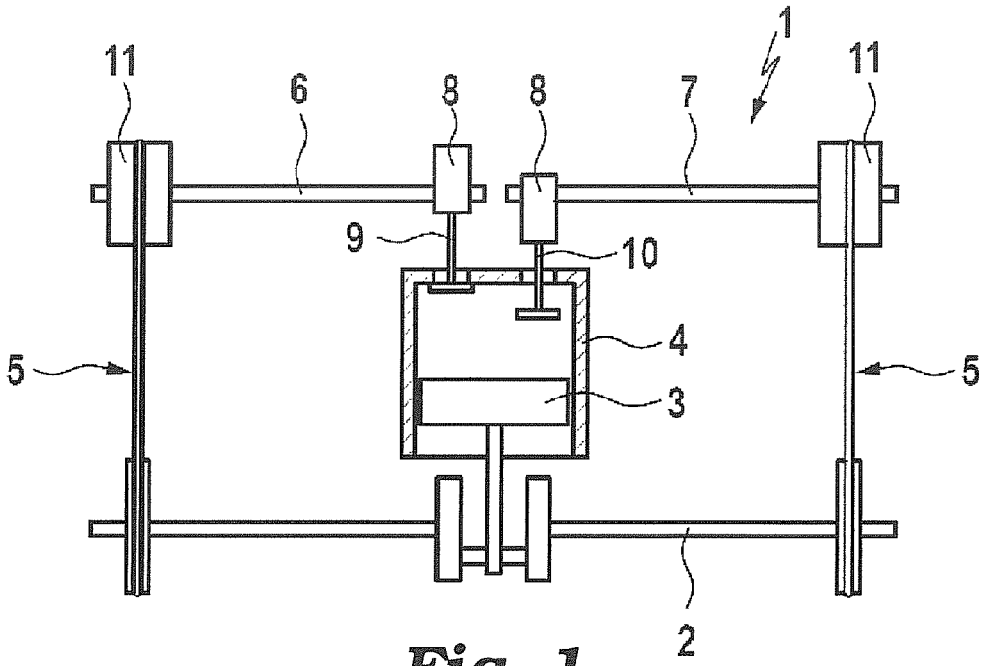
FIG. 1 only very schematically, an internal combustion engine.

In FIG. 1, an internal combustion engine 1 is shown schematically, wherein a piston 3 sitting on a crankshaft 2 is indicated in a cylinder 4. The crankshaft 2 connects to an intake camshaft 6 or an exhaust camshaft 7 in the illustrated embodiment by means of a traction mechanism drive 5, wherein a first and a second device 11 for the variable adjustment of the control times of gas exchange valves 9, 10 can provide for a relative rotation between the crankshaft 2 and the camshafts 6, 7. The cams 8 of the camshafts 6, 7 actuate one or more intake gas exchange valves 9 and one or more exhaust gas exchange valves 10, respectively.

Figure 2:
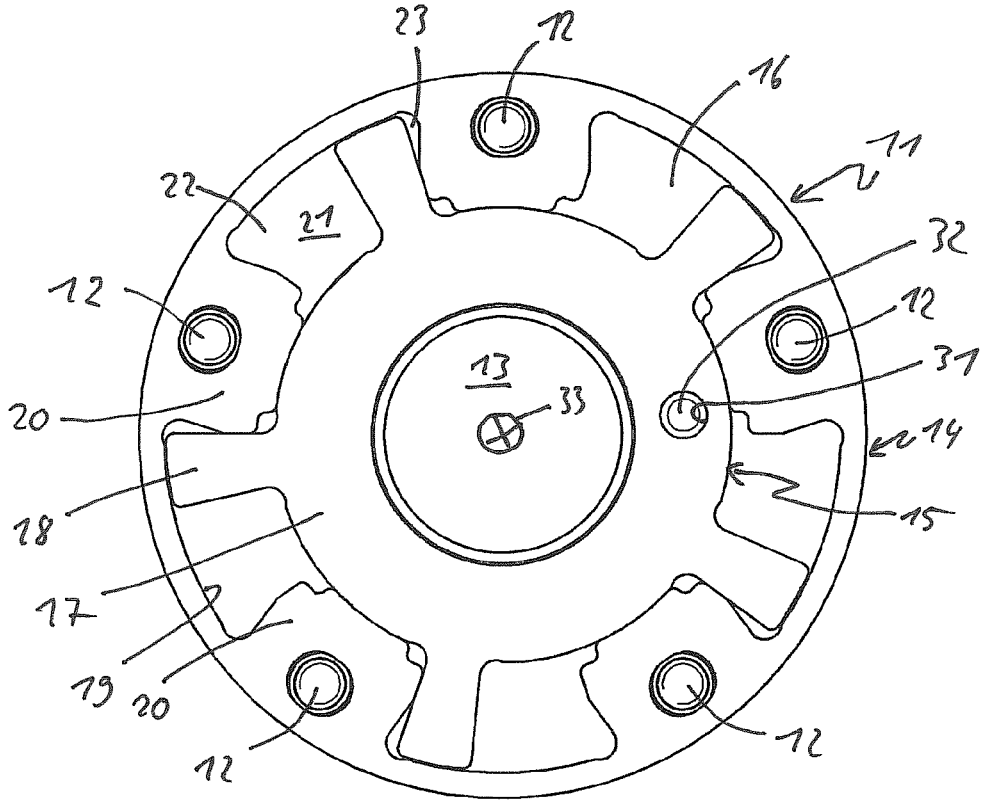
FIG. 2 a device for the variable adjustment of the control times of gas exchange valves of an internal combustion engine in a top view along the axis of rotation of the device with an impeller according to the invention, FIG. 3 a perspective view of the impeller from FIG. 2, FIG. 4 a sub-element of the impeller from FIG. 3 in a top view, and FIG. 5 a perspective diagram of the sub-element from FIG. 4.

FIG. 2 shows a device 11 according to the invention in a top view along an axis of rotation 33 of the device 11. The device 11 has a cell wheel 14, an impeller 15, and two side covers 16. The side covers are arranged on axial side surfaces of the cell wheel 14 and attached to this by means of screws 12. In FIG. 2, only the rear side cover 16 is shown. The impeller 15 is made from a suitable plastic and has an essentially cylindrical hub element 17 from whose outer cylindrical lateral surface five vanes 18 extend outward in the radial direction. In the illustrated embodiment, the vanes 18 are formed integrally with the hub element 17. Also conceivable are embodiments in which the vanes 18 are formed separately from the hub element 17 and are arranged in vane grooves that are formed on the cylindrical lateral surface of the hub element 17. In this case, the vanes 18 can also be produced from plastic. Also conceivable are vanes 18 made from a metallic material, for example, from steel.

Starting from an outer peripheral wall 19 of the cell wheel 14, five projections 20 extend inward in the radial direction. In the illustrated embodiment, the projections 20 are formed integrally with the peripheral wall 19. The cell wheel 14 is supported on the impeller so that it can rotate relative to this impeller 15 by means of radially inner peripheral walls of the projections 20.

On the not-shown side cover, a similarly not-shown chain wheel is formed by means of which torque can be transmitted from the crankshaft 2 to the cell wheel 14 by means of the traction mechanism drive 5. The impeller 15 is locked in rotation with the camshaft 6, 7 in the assembled state. For this purpose, the impeller 15 has a central opening 13 that is penetrated by a not-shown central screw that is screwed to the camshaft 6, 7.

Within the device 11, a pressure space 21 is formed between every two projections 20 adjacent in the peripheral direction. Each of the pressure spaces 21 is bounded in the peripheral direction by adjacent projections 20, in the axial direction by the side covers 16, inward in the radial direction by the hub element 17, and outward in the radial direction by the peripheral wall 19. In each of the pressure spaces 21, a vane 18 projects, wherein the vanes 18 contact both the side covers 16 and also the peripheral wall 19. Each vane 18 thus divides the respective pressure space 21 into two counteracting pressure chambers 22, 23.

By pressurizing a group of pressure chambers 22, 23 and depressurizing the other group, the phase position of the impeller 15 to the cell wheel 14 and thus the phase position of the camshaft 6, 7 to the crankshaft 2 can be varied. By pressurizing both groups of pressure chambers 22, 23, the phase position can be kept constant.

The impeller 15 has a blind-hole-like receptacle 31 that is formed open on an axial side surface of the impeller. A locking pin 32 that can move in the axial direction is held in the receptacle 31, wherein a force is applied to this locking pin by a spring in the direction of the not-shown side cover. The not-shown side cover has a slot in which the locking pin 32 can engage when this is opposite the slot in the axial direction. Thus, a mechanical coupling between the impeller 15 and the cell wheel 14 can be produced and can be disconnected by feeding pressurized medium to the slot.

Figure 3:
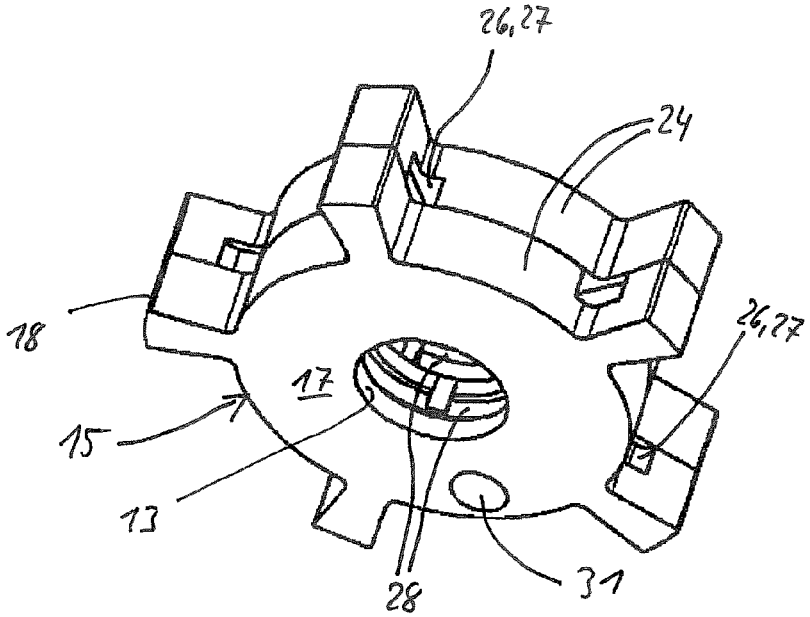

The impeller 15 is formed of two sub-elements 24 (FIG. 3) that are set opposite each other and contact each other along a separating plane running in the illustrated embodiment perpendicular to the axis of rotation 33 of the device 11 or the impeller 15. The two sub-elements 24 are attached to each other by means of an adhesive connection.

Figure 4:
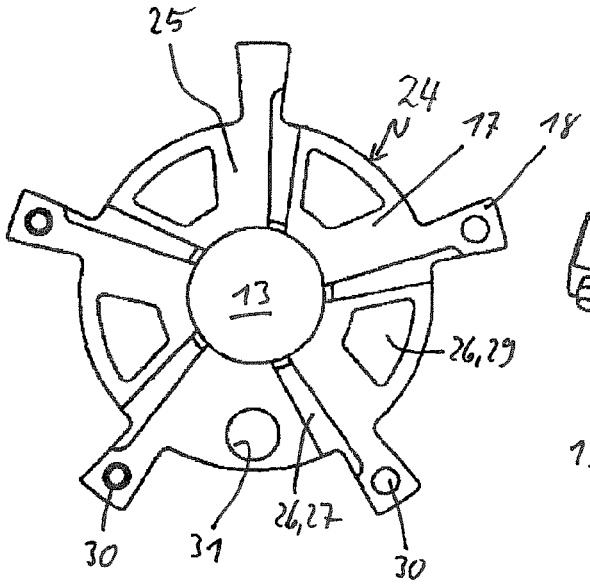
Figure 5:
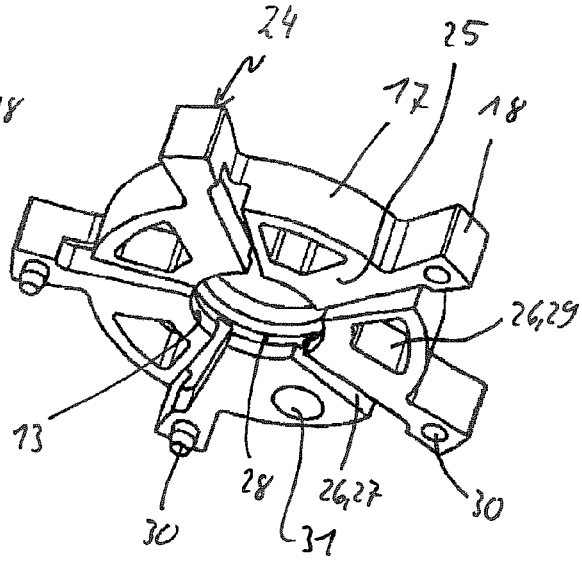

The side surfaces 25 of the sub-elements 24 contacting each other have several recesses 26 (FIGS. 4 and 5). First recesses 26 are constructed as radial grooves 27. The grooves 27 extend up to an opening on the outer cylindrical lateral surface of the hub element 17 starting from a ring channel 28 formed in the central opening 13. Here, the grooves 27 simultaneously extend into the area of the vanes 18. The grooves 27 thus communicate with an area of the pressure chambers 22, 23, adjacent to the vanes 18 in the peripheral direction. Both sub-elements 24 have identical forms with respect to the grooves 27, so that after their assembly, the grooves 27 of one sub-element 24 are closed in the axial direction by an area of the side surface 25 of the other sub-element 24. Thus, the grooves 27 are used as pressurized medium channels by means of which pressurized medium can be fed from the ring channels 28 to the pressure chambers 22, 23 or pressurized medium can be discharged from the pressure chambers 22, 23 to the ring channels 28. Through the construction of the pressurized medium channels as grooves 27 in the sub-elements 24, it is achieved that the pressurized medium channels are not constructed on an axial side surface of the impeller 15. Thus, no axial forces act on the impeller 15 when the grooves 27 are pressurized, wherein the frictional forces between the side covers 16 and the side surfaces of the impeller 15 are minimized. In addition, the grooves 27 are formed without added costs during the shaping process of the sub-elements 24, for example, during an injection molding process. Thus, no additional metal-cutting post processing steps, for example, drilling of the pressurized medium channels, are necessary.

In addition to the grooves 27, second recesses 26 that are constructed as blind holes 29 are provided on the side surfaces 25 of the sub-elements contacting each other. The only opening of the blind holes 29 is in the joint plane of the two sub-elements 24. Thus, the axial side surfaces of the impeller 15 are formed without recesses. The blind holes 29 can also be formed during the shaping process of the sub-elements 24. Thus, the material costs and the weight of the impeller 15 are reduced. Simultaneously, the sealing effect between the side covers 16 and the hub element 17 is increased due to the smooth side surfaces of the impeller 15, so that leakage from the pressure chambers 22, 23 to the central opening 13 is reduced.

Each of the sub-elements 24 has, in addition to the described structures, positive-fit elements 30 that are formed in the vanes 18. Here, a peg is formed on each of two vanes 18 and an opening adapted to the peg is formed on each of two additional vanes 18. When the sub-elements 24 are joined, the pegs engage in the corresponding openings, so that the sub-elements 24 are automatically positioned relative to each other.

The two sub-elements 24 have identical constructions, so that only one injection-molding mold is required for their production.

Reference Symbols

1 Internal combustion engine
2 Crankshaft
3 Piston
4 Cylinder
5 Traction mechanism drive
6 Intake camshaft
7 Exhaust camshaft
8 Cam
9 Intake gas exchange valve
10 Exhaust gas exchange valve
11 Device
12 Screw
13 Central opening
14 Cell wheel
15 Impeller
16 Side cover
17 Hub element
18 Vane
19 Peripheral wall
20 Projection
21 Pressure space
22 First pressure chamber
23 Second pressure chamber
24 Sub-element
25 Side surface
26 Recess
27 Groove
28 Ring channel
29 Blind hole
30 Positive-fit element
31 Receptacle
32 Locking pin
33 Axis of rotation

The invention claimed is:

1. An impeller of a device for variable adjustment of control times of gas exchange valves of an internal combustion engine comprising an essentially cylindrical hub element and at least one vane that extends outward in a radial direction starting from the hub element, wherein at least the hub element is produced from a non-metallic material, the impeller is made from at least two sub-elements, wherein the sub-elements are set opposite each other in a direction of an axis of rotation of the impeller and contact each other at contacting side surfaces, wherein the sub-elements are connected to each other and the contacting side surfaces each include at least one recess.

2. The impeller according to claim 1, wherein the recess is closed by an opposite one of the sub-elements in a direction of the opposite one of the sub-elements.

3. The impeller according to claim 1, wherein the recess has a blind hole-shaped construction.

4. The impeller according to claim 1, wherein the recess is constructed as a groove that extends outward in the radial direction starting from a central opening of the impeller and opens in an area adjacent to the vanes in a peripheral direction.

5. The impeller according to claim 1, wherein the sub-elements are connected to each other by a weld or adhesive connection.

6. The impeller according to claim 1, wherein the sub-elements are connected to each other by a non-positive-fit.

7. The impeller according to claim 1, wherein the sub-elements are connected to each other by a positive-fit connection.

8. The impeller according to claim 1, wherein the sub-elements have an identical construction.

* * * * *